US007624874B2

(12) United States Patent
Douglas

(10) Patent No.: US 7,624,874 B2
(45) Date of Patent: Dec. 1, 2009

(54) SANITARY PACK CONTAINER

(76) Inventor: Jerrine A. Douglas, 7901 Cedarbrook Ave., Philadelphia, PA (US) 19150

( * ) Notice: Subject to any disclaimer, the term of this patent is extended or adjusted under 35 U.S.C. 154(b) by 187 days.

(21) Appl. No.: 12/004,680

(22) Filed: Dec. 21, 2007

(65) Prior Publication Data

US 2008/0164179 A1 Jul. 10, 2008

Related U.S. Application Data

(60) Provisional application No. 60/879,442, filed on Jan. 8, 2007.

(51) Int. Cl.
*B65D 71/00* (2006.01)
*B65D 25/00* (2006.01)

(52) U.S. Cl. ..... 206/581; 220/9.4

(58) Field of Classification Search ..... 206/581, 206/554, 494, 577, 756, 438, 499, 570; 220/9.2, 220/9.4, 495.08, 495.11, 23.83, 23.86, 260, 220/506, 551

See application file for complete search history.

(56) References Cited

U.S. PATENT DOCUMENTS

| | | | | |
|---|---|---|---|---|
| 3,014,516 | A * | 12/1961 | Mueller | 220/9.2 |
| 4,349,123 | A * | 9/1982 | Yang | 220/495.07 |
| 6,554,149 | B2 * | 4/2003 | Schneider et al. | 220/9.3 |
| 2005/0211583 | A1 * | 9/2005 | Gray | 206/321 |
| 2005/0284866 | A1 * | 12/2005 | Oakner et al. | 220/9.2 |

* cited by examiner

*Primary Examiner*—J. Gregory Pickett
(74) *Attorney, Agent, or Firm*—Howson & Howson LLP

(57) ABSTRACT

A sanitary pack container is composed of a collapsible, coil spring-supported, fabric tube disposed inside a rectangular enclosure. The collapsible tube serves as a support for disposable plastic bags, a supply of which is stored in the container along with a supply of tissue papers and a supply of chemically treated sanitary wipes.

5 Claims, 3 Drawing Sheets

SANITARY PACK CONTAINER

CROSS-REFERENCE TO RELATED APPLICATION

This application claims priority from Provisional Application 60/879,442, filed Jan. 8, 2007.

FIELD OF THE INVENTION

This invention relates to a sanitary pack for personal use, for the purpose of receiving, and temporarily storing for later disposal, nasal and/or oral discharge.

BACKGROUND OF THE INVENTION

Nasal and oral discharges that typically accompany conditions such as the common cold are ordinarily collected in cloth handkerchiefs, or in tissue paper. Both handkerchiefs and tissue paper are unsanitary as normally used. Cloth handkerchiefs are typically used more than once, and must be washed under disinfecting conditions. Tissue papers are disposed of after a single use. However, depending on the manner of their disposal, they can cause infectious conditions. Moreover, there are frequent occasions when tissue papers cannot be discarded discreetly.

BRIEF SUMMARY OF THE INVENTION

The sanitary pack container according to the invention comprises an enclosure having a manually closable and openable lid, and a bag support disposed within the container. The bag support has a tubular wall which is collapsible to a dimension such that it can fit entirely inside the enclosure when the lid is closed. However, the bag support is expansible to a dimension such that it cannot fit entirely inside the enclosure, and extends out from the container when in use. The tubular wall has an end opening that includes a stiff member arranged to hold the end opening in an open condition. A supply of flexible plastic bags is provided within the enclosure, each bag having a bottom, a wall, and an opening opposite the bottom, and being of a size such that the bottom can fit inside the bag support, and such that the wall of the bag can be folded over the end opening of the wall of the support, so that the bag can be held by the support in an open condition to receive nasal or oral discharge, and then closed. The enclosure is sufficiently large to provide space for temporary storage of a used bag prior to disposal of the used bag.

Preferably, a supply of tissues and a supply of sanitary wipes are also included within the container.

In a preferred embodiment of the sanitary pack container, the tubular wall of the bag support comprises a flexible sheet and a coil of metal spring wire disposed within the tubular wall. The stiff member that holds the end opening of the bag support in an open condition is preferably formed by a part of said coil of metal spring wire.

The sanitary pack container according to the invention can be carried by an individual, and provides a convenient and sanitary means for collecting and disposing of potentially infectious matter.

Other objects, details and advantages of the invention will be apparent from the following detailed description when read in conjunction with the drawings.

DETAILED DESCRIPTION OF THE PREFERRED EMBODIMENT

Figure 1:
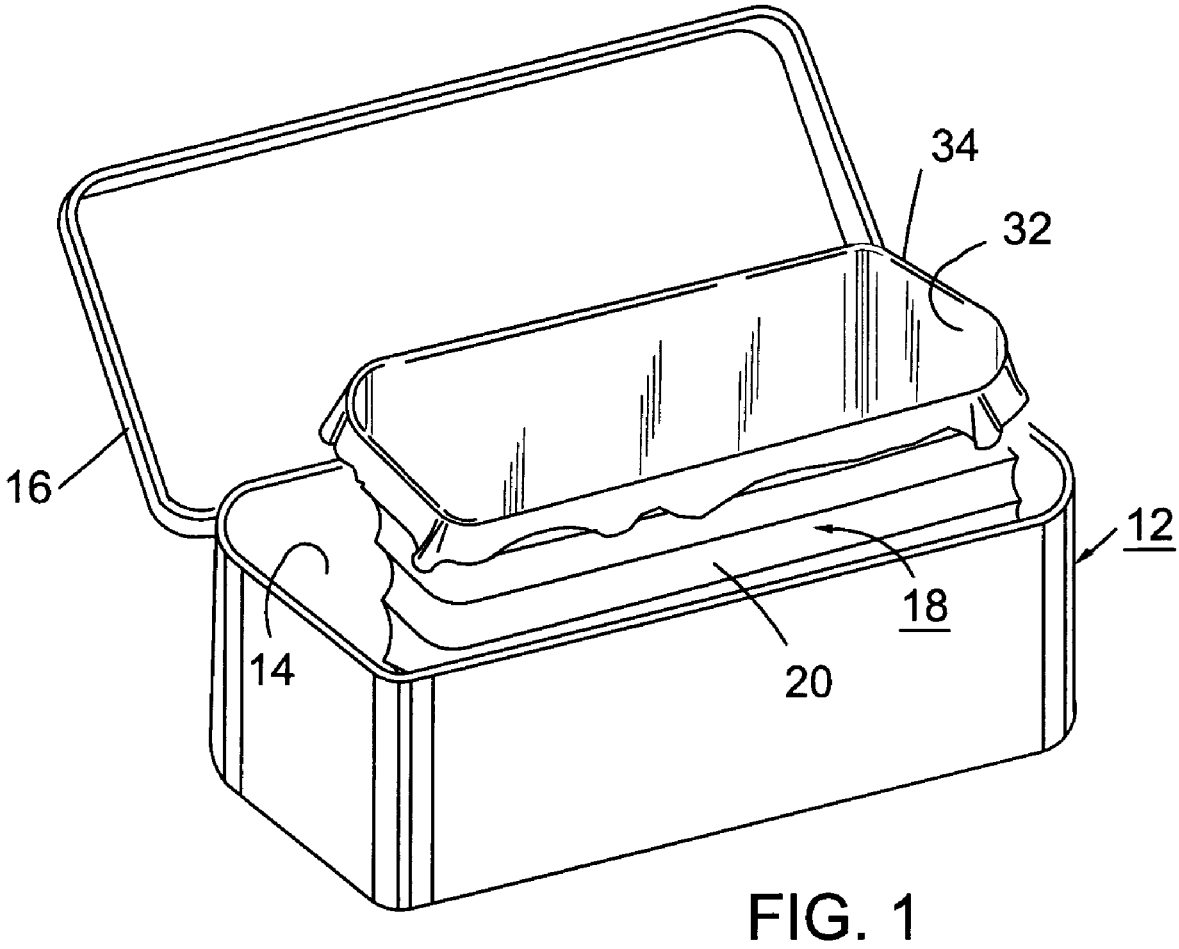
FIG. 1 is a perspective view of a sanitary pack container according to the invention, showing the container in a condition ready for use.

As shown in FIG. 1, the container comprises a generally rectangular box-shaped enclosure 12, having a top opening 14 closable by a hinged lid 16. The container 12 illustrated in FIG. 1 is typical, and is 5½ inches in length, 2 inches wide and 1½ inches deep. The container, of course, can be provided in any suitable size or shape.

Figure 2:
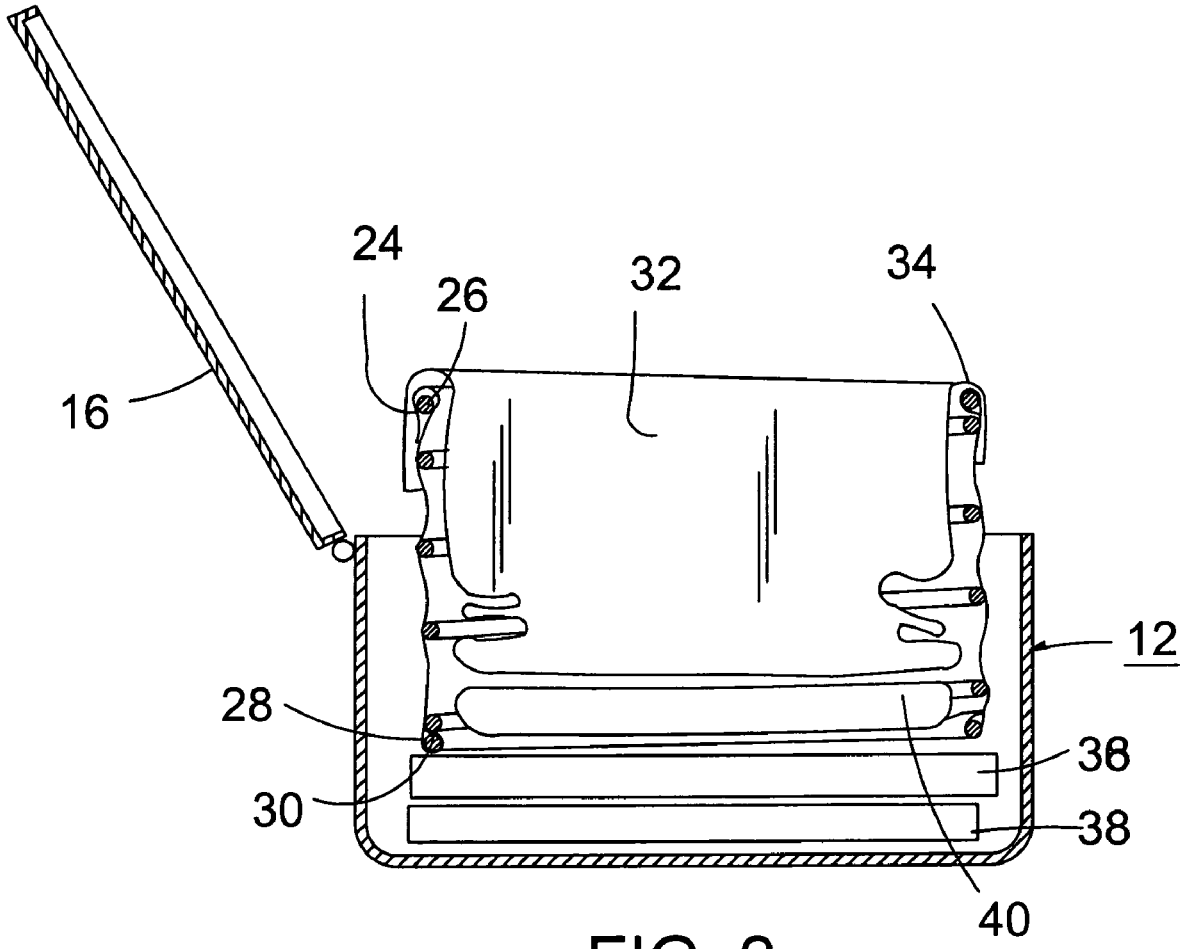
FIG. 2 is a sectional view showing the container in an open condition.
Figure 3:
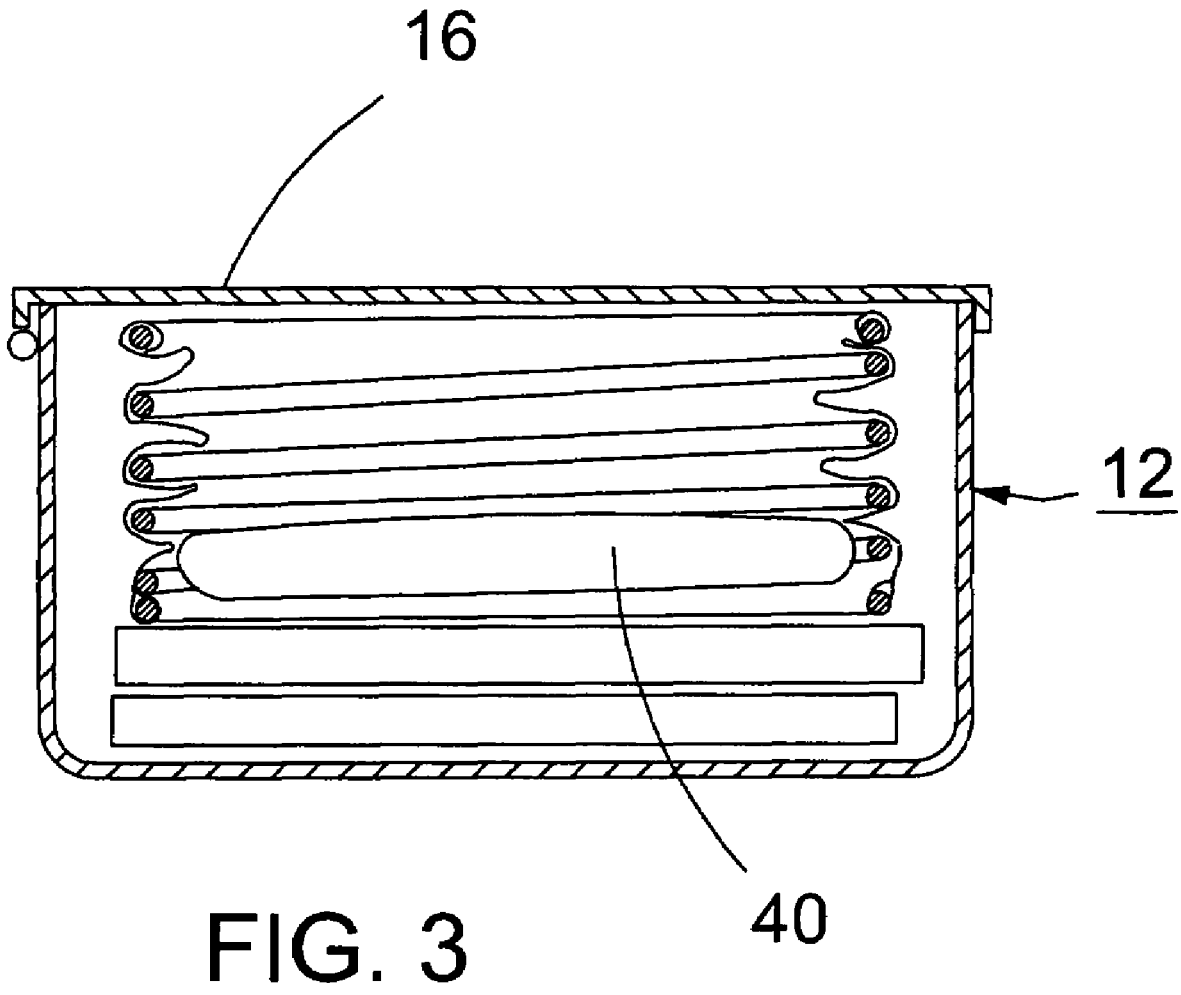
FIG. 3 is a sectional view showing the container in a closed condition.

Disposed inside the container is a collapsible bag support 18, which comprises a tubular wall 20, preferably of fabric, held in an expanded condition by a coil spring 22, as shown in FIG. 2. Outward horizontal expansion of spring 22 is limited by the tubular fabric wall so that the fabric is held taut. The spring 22 also expands vertically, stretching the tube of fabric to its limit, in which case, it can extend upward from the interior of the container and outward through opening 14 as illustrated in FIG. 2. The spring-supported tubular wall can be pressed downward manually so that it can fit entirely inside the container as illustrated in FIG. 3.

As shown in FIG. 2, the fabric 22 has a hem 24 sewn around a topmost turn 26 of the wire coil, and another hem 28 sewn around the lowermost turn 30 of the coil, so that the tubular fabric wall is stretched vertically when the spring is expanded. The topmost turn serves as a stiffener, hold the upper end opening of the collapsible bag support 18 in an open condition.

A disposable bag 32, preferably composed of polyethylene film or a similar material, is fitted into the support, with its upper end 34 folded outward over the upper edge of the support and downward for a short distance along the outside of the support. In FIGS. 1 and 2, the bag is shown ready to receive nasal or oral discharge. After use, it can be removed from the support, closed and tied, preferably by twisting its upper end, and then tying the upper end in a simple overhand knot. An auxiliary tie, such as a wire tie (not shown) can be used as an alternative to close off the bag.

Following use, the closed bag can be discarded into a trash receptacle, of one is available. If no trash receptacle is immediately available, the closed bag can be placed inside the collapsible support 18, for later disposal. The collapsible support can be compressed manually, and the lid 16 closed to hold the support in its collapsed condition. The lid can be held closed by friction. Alternatively, a suitable latch (not shown) can be provided.

The container is preferably provided, underneath the collapsible support, with a package 36 containing a supply of tissue paper sheets, and a package 38 containing a supply of chemically treated sanitary wipes 38 that can be used as a disinfectant. A package 40, containing a supply of disposable bags, suitable for use in the container, can be maintained inside the collapsible support.

Various modifications can be made to the device as shown. For example, the tubular fabric wall of the support can be made with a closed bottom, in which case, hem 28 is unnecessary. The support is preferably provided with an internal spring as shown to maintain the support in an outwardly stretched and upwardly expanded condition. It is possible to realize many of the advantages of the invention using a similar support in which the open upper end is maintained open by a stiff, ring-like member corresponding to upper turn 26 of spring 22. However, in that case, other measures are taken to hold the support in its vertically expanded condition. The size and shape of the container can be selected according to the user's needs, and the closure of the container need not be hinged, but can be, for example, a sliding closure, or a completely removable enclosure. A spring clip can be affixed to the outside of the enclosure to enable the sanitary pack container to be conveniently attached to a pocket or another article.

Still other modifications may be made to the apparatus and method described above without departing from the scope of the invention as defined in the following claims.

The invention claimed is:

1. A sanitary pack container for personal hygiene comprising:

an enclosure having a manually closable and openable lid;

a support disposed within the container, the support having a tubular wall, the wall being collapsible to a dimension such that it can fit entirely inside the enclosure when the lid is closed, and being expansible to a dimension such that it cannot fit entirely inside the enclosure, the wall having an end opening that includes a stiff member arranged to hold the end opening in an open condition; and a supply of flexible plastic bags within the enclosure, each bag having a bottom, a wall, and an opening opposite the bottom, and being of a size such that the bottom can fit inside the support, and such that the wall of the bag can be folded over said end opening of the wall of the support, whereby the bag can be held by the support in an open condition to receive nasal or oral discharge, and then closed;

the enclosure being sufficiently large to provide space for temporary storage of a used bag prior to disposal of the used bag.

2. A sanitary pack container according to claim 1, including a supply of tissues within said container.

3. A sanitary pack container according to claim 1, including a supply of sanitary wipes within said container.

4. A sanitary pack container according to claim 1, in which said tubular wall comprises a flexible sheet and having a coil of metal spring wire disposed within said tubular wall.

5. A sanitary pack container according to claim 4, in which said stiff member is formed by a part of said coil of metal spring wire.

* * * * *